United States Patent [19]

Ritzi

[11] 4,258,551

[45] Mar. 31, 1981

[54] MULTI-STAGE, WET STEAM TURBINE

[75] Inventor: Emil W. Ritzi, Manhattan Beach, Calif.

[73] Assignee: Biphase Energy Systems, Santa Monica, Calif.

[21] Appl. No.: 17,456

[22] Filed: Mar. 5, 1979

[51] Int. Cl.[3] ..... F01K 7/00; F01K 7/38

[52] U.S. Cl. ..... 60/654; 60/649; 60/677; 60/689

[58] Field of Search ..... 60/654, 649, 670, 688, 60/689, 677

[56] References Cited

U.S. PATENT DOCUMENTS

| | | | |
|---|---|---|---|
| 1,803,054 | 4/1931 | Broido | 60/654 |
| 3,358,451 | 12/1967 | Feldman et al. | 60/649 |
| 3,879,949 | 4/1975 | Hays et al. | 60/649 |
| 4,106,294 | 8/1978 | Czaja | 60/649 |
| 4,141,219 | 2/1979 | Elliot | 60/649 X |
| 4,143,516 | 3/1979 | Long . | |

*Primary Examiner*—Allen M. Ostrager

*Attorney, Agent, or Firm*—William W. Haefliger

[57] ABSTRACT

A multi-stage, wet steam turbine employs working fluid, such as steam for example, in its two-phase region with vapor and liquid occurring simultaneously for at least part of the cycle, in particular the nozzle expansion. A smaller number of stages than usual is made possible, and the turbine may handle liquid only. Simple construction, low fuel consumption and high reliability are achieved.

19 Claims, 6 Drawing Figures

TEMPERATURE-ENTROPY DIAGRAM SHOWING A SAMPLE CYCLE USING WET STEAM $\eta \cong 20\%$

MULTI-STAGE, WET STEAM TURBINE

BACKGROUND OF THE INVENTION

This invention is concerned with a new class of heat engines where the working fluid, for example steam, is used in its two-phase region with vapor and liquid occurring simultaneously for at least part of the cycle, in particular the nozzle expansion. The fields of use are primarily those where lower speeds and high torques are required, for example, as a prime mover driving an electric generator, an engine for marine and land propulsion, and generally as units of small power output. No restrictions are imposed on the heat source, which may be utilizing fossil fuels burned in air, waste heat, solar heat, or nuclear reaction heat etc.

The proposed engine is related to existing steam turbine engines; however, as a consequence of using large fractions of liquid in the expanding part of the cycle, a much smaller number of stages may usually be required, and the turbine may handle liquid only. Also, the thermodynamic cycle may be altered considerably from the usual Rankine cycle, inasmuch as the expansion is taking place near the liquid line of the temperature-entropy diapgram, and essentially parallel to that line, as described below. In contrast to other proposed two-phase engines with two components (a high-vapor pressure component and a low-vapor pressure component, see U.S. Pat. Nos. 3,879,949 and 3,972,195), the present engine is limited to a single-component fluid, as for example water, the intent being to simplify the working fluid storage and handling, and to improve engine reliability by employing well proven working media of high chemical stability.

SUMMARY OF THE INVENTION

It is a major object of the invention to provide an economical engine of low capital cost due to simple construction, low fuel consumption, high reliability, and minimum maintenance requirements.

The objective of low fuel consumption is achieved by "Carnotizing" the heat engine cycle in a fashion similar to regenerative feed-water preheating, which consists in extracting expanding steam from the turbine in order to preheat feed-water by condensation of the extracted steam. Since the pressure of the heat emitting condensing vapor and the heat absorbing feed-water can be made the same, a direct-contact heat exchanger may be used, which is of high effectiveness and typically of very small size.

Further, and in contrast to the conventional regenerative feed-water heating scheme, the expanding steam is of low quality, typically of 10 to 20% mass fraction of vapor in the total wet mixture flow. As a result, the enthalpy change across the nozzle is reduced to such a degree that a two-stage turbine, for example, is able to handle the entire expansion head at moderate stress levels. By way of contrast, a comparable conventional impulse steam turbine would require about fifteen stages. The turbine itself may consist of a liquid turbine that may be combined with a rotary separator in the manner to be described.

These and other objects and advantages of the invention, as well as the details of an illustrative embodiment, will be more fully understood from the following description and drawings, in which:

DRAWING DESCRIPTION

DETAILED DESCRIPTION

Figure 1:
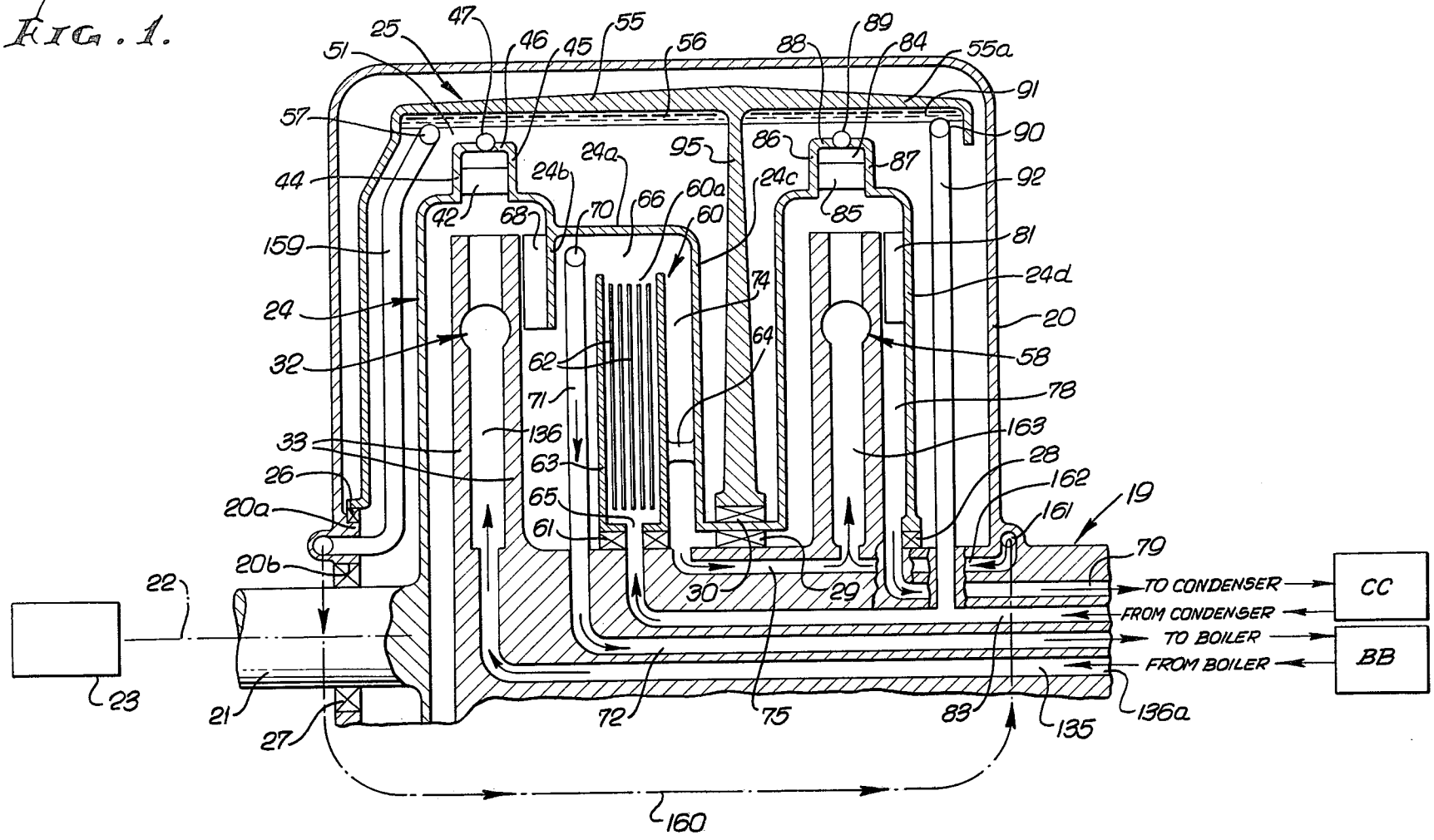
FIG. 1 is an axial vertical elevation, in section, schematically showing a two-stage liquid turbine, with recuperator.

Referring first to FIG. 1, the prime mover apparatus shown includes fixed, non-rotating structure 19 including a casing 20, an output shaft 21 rotatable about axis 22 to drive and do work upon external device 23; rotary structure 24 within the casing and directly connected to shaft 21; and a free wheeling rotor 25 within the casing. A bearing 26 mounts the rotor 25 to a casing flange 20*a*; a bearing 27 centers shaft 21 in the casing bore 20*b*; bearings 28 and 29 mount structure 24 on fixed structure 19; and bearing 30 centers rotor 25 relative to structure 24.

Figure 3:
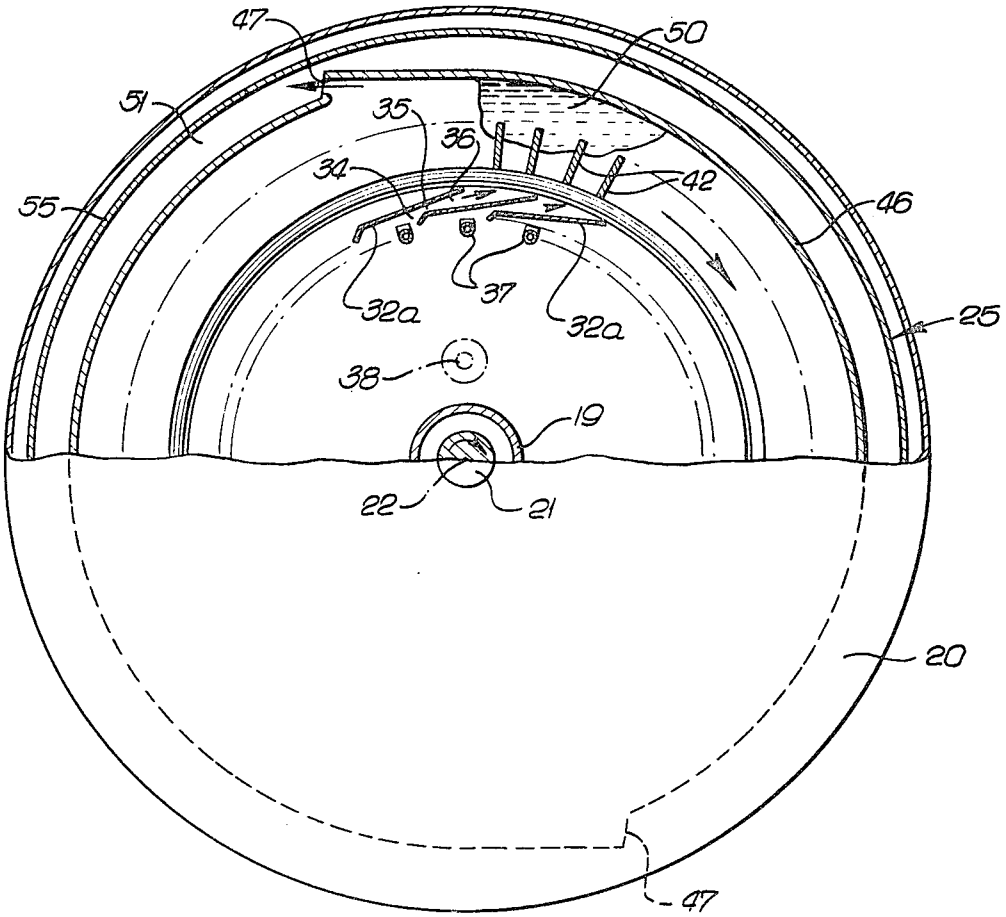
FIG. 3 is an axial view of the FIG. 2 apparatus.
Figure 2:
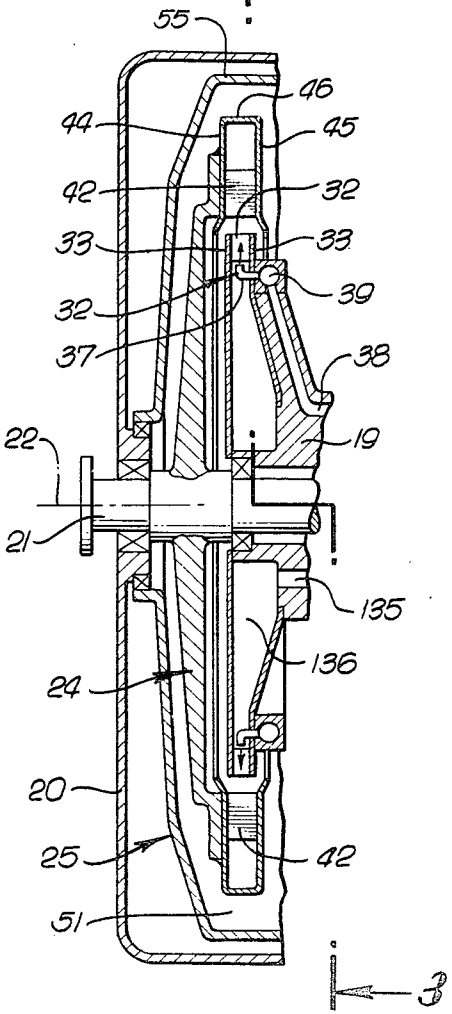
FIG. 2 is a vertical section showing details of the FIG. 1 apparatus, and taken along the axis.
Figure 4:
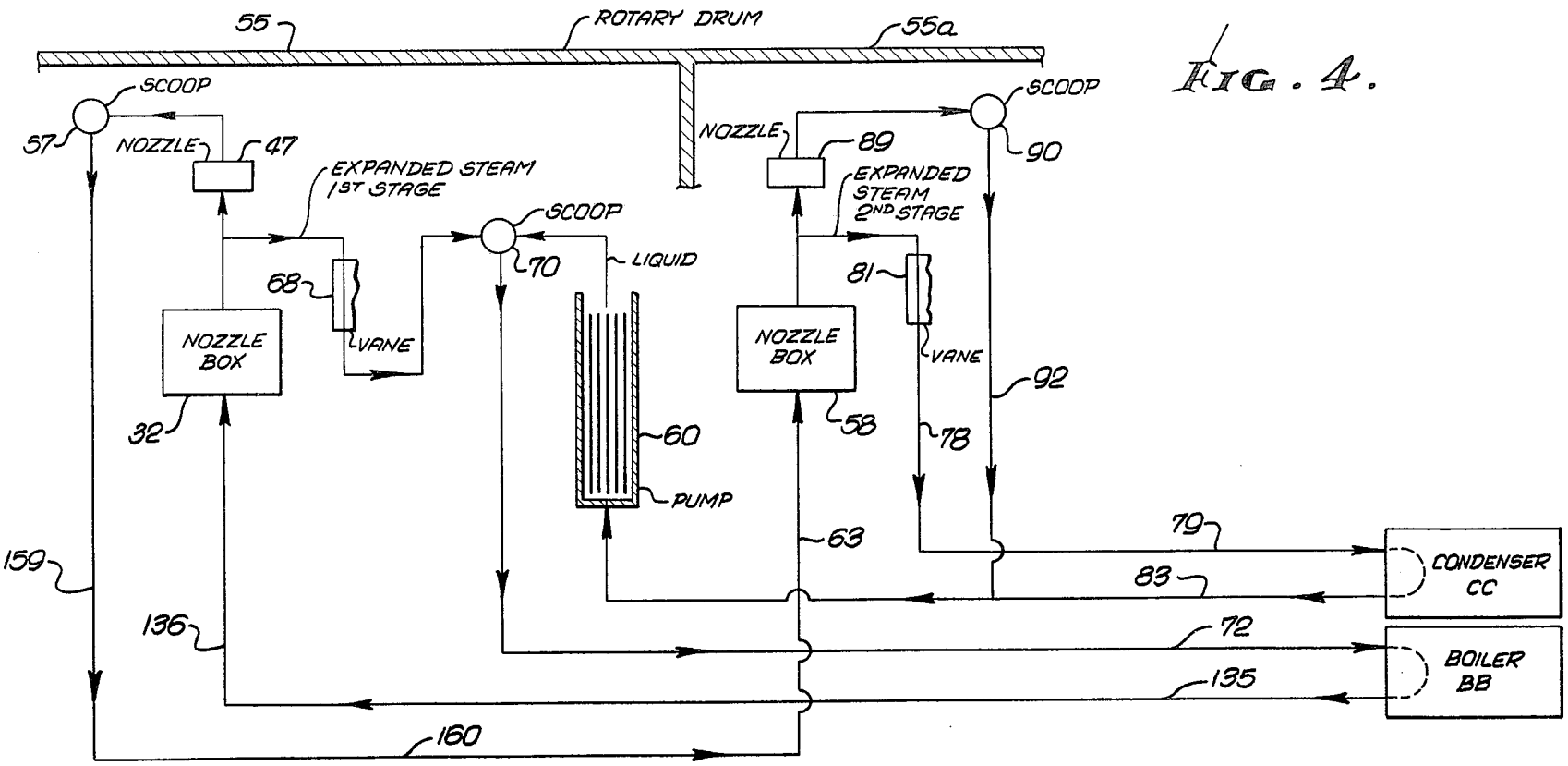
FIG. 4 is a flow diagram.

In accordance with the invention, first nozzle means, as for example nozzle box 32, is associated with fixed structure 19, and is supplied with wet steam for expansion in the box. As also shown in FIGS. 2 and 3, the nozzle box 32 typically includes a series of nozzle segments 32*a* spaced about axis 22 and located between parallel walls 33 which extend in planes which are normal to that axis. The nozzles define venturis, including convergent portion 34 throat 35 and divertent portion 36. Walls 33 are integral with fixed structure 19. Wet steam may be supplied from boiler BB along paths 135 and 136 to the nozzle box. FIGS. 2 and 3 shows the provision of fluid injectors 37 operable to inject fluid such as water into the wet steam path as defined by annular manifold 39, immediately upstream of the nozzles 32. Such fluid may be supplied via a fluid inlet 38 to a ring-shaped manifold 39 to which the injectors are connected. Such injectors provide good droplet distribution in the wet steam, for optimum turbine operating efficiency, expansion of the steam through the nozzles accelerating the water droplets for maximum impulse delivery to the turbine vanes 42. A steam inlet is shown at 136*a*.

Rotary turbine structure 24 provides first vanes, as for example at 42 spaced about axis 22, to receive and pass the water droplets in the steam in the nozzle means 32. In this regard, the steam fraction increases when expanding. Such first vanes may extend in axial radial planes, and are typically spaced about axis 22 in circular sequence. They extend between annular walls 44 and 45 of structure 24, to which an outer closure wall 46 is joined. Wall may form one or more nozzles, two being shown at 47 in FIG. 3. Nozzles 47 are directed generally counterclockwise in FIG. 3, whereas nozzles 32 are directed generally clockwise, so that turbine structure 24 rotates clockwise in FIG. 3. The turbine structure is basically a drum that contains a ring of liquid (i.e. water ring indicated at 50 in FIG. 3), which is collected from the droplets issuing from nozzles 32. Such water issuing as jets from nozzles 47 is under pressurization generated by the rotation of the solid ring of water 50. In this manner, the static pressure in the region 51 outwardly of the turbine structure need not be lower than the pressure of the nozzle 32 discharge to assure proper liquid acceleration across such nozzles 47. The radial vanes 42 ensure solid body rotation of the ring of liquid at the speed of the structure 24. The vanes are also useful in assuring a rapid acceleration of the turbine from standstill or idle condition.

Water collecting in region 51 impinges on the freely rotating rotor 55 extending about turbine rotor structure 24, and tends to rotate that rotor with a rotating ring of water collecting at 56. A non-rotating scoop 57 extending into zone 51 collects water at the inner surface of the ring 56, the scoop communicating with second nozzle means 58 to be described, as via ducts or paths 159–163. Accordingly, expanded first stage liquid (captured by free-wheeling drum or rotor 55 and scooped up by pitot opening 57) may be supplied in pressurized state to the inlet of second stage nozzle 58.

Also shown in FIG. 1 is what may be referred to as rotary means to receive feed water and to centrifugally pressurize same. Such means may take the form of a centrifugal rotary pump 60 mounted as by bearings 61 to fixed structure 19. The pump may include a series of discs 62 which are normal to axis 22, and which are located within and rotate with pump casing 63 rotating at the same speed as the turbine structure 24. For that purpose, a connection 64 may extend between casing 63 and the turbine 24. The discs of such a pump (as for example a Tesla pump) are closely spaced apart so as to allow the liquid or water discharge from inlet spout 65 to distribute generally uniformly among the individual slots between the plates and to flow radially outwardly, while gaining pressure.

A recuperative zone 66 is provided inwardly of the turbine wall structure **24*a* to communicate with the discharge 60*a* of rotating pump 60, and with the nozzle box 32 via a series of steam passing vanes 68. The latter are connected to the turbine rotor wall 24*b* to receive and pass steam discharging from nozzles 32, imparting further torque to the turbine rotor. After passage between vanes 68, the steam is drawn into direct heat exchange contact with the water droplets spun-off from the pump 60, in heat exchange, or recuperative zone 66. Both liquid droplets and steam have equal swirl velocity and are at equal static pressure in rotating zone 66**, as they mix therein.

The mix is continuously withdrawn for further heating and supply to the first nozzle means 32. For the purpose, a scoop 70 may be associated with fixed structure 19, and extend into zone 66 to withdraw the fluid mix for supply via fixed duct 71 and 72 to boiler or heater BB, from which the fluid mix is returned via path 135 to the nozzle means 32.

The second stage nozzle means 58 receives water from scoop 57, as previously described, and also steam spill-over from space 66, as via paths 74 and 75 adjacent turbine wall **24*c*. Such pressurized steam mixed with liquid from scoop 57 is expanded in the second nozzle means 58 producing vapor and water, the vapor being ducted via paths 78 and 79 to condenser CC. Fourth vanes 81 attached to rotating turbine wall 24*d* receive pressure application from the flowing steam to extract energy from the steam and to develop additional torque. The condensate from the condenser is returned via path 83 to the inlet 65 of pump 60. The water from nozzle means 58 collects in a rotating ring in region 84, imparting torque to vanes 85 in that region bounded by turbine rotor walls 86 and 87, and outer wall 88. For that purpose, the construction may be the same as that of the first nozzle means 32, water ring 50, vanes 42 and walls 44–46. Nozzles 89 discharge water from the rotating ring in region 84, and correspond to nozzles 47. Free wheeling rotor 55 extends at 55*a* about nozzle 47, and collects water discharging from the latter, forming a ring in zone 91 due to centrifugal effect. Non-rotary scoop 90 collects water in the ring formed by rotor extent 55*a*, and ducts it at 92 to path 83 for return to the TESLA pump 60**.

Figure 5:
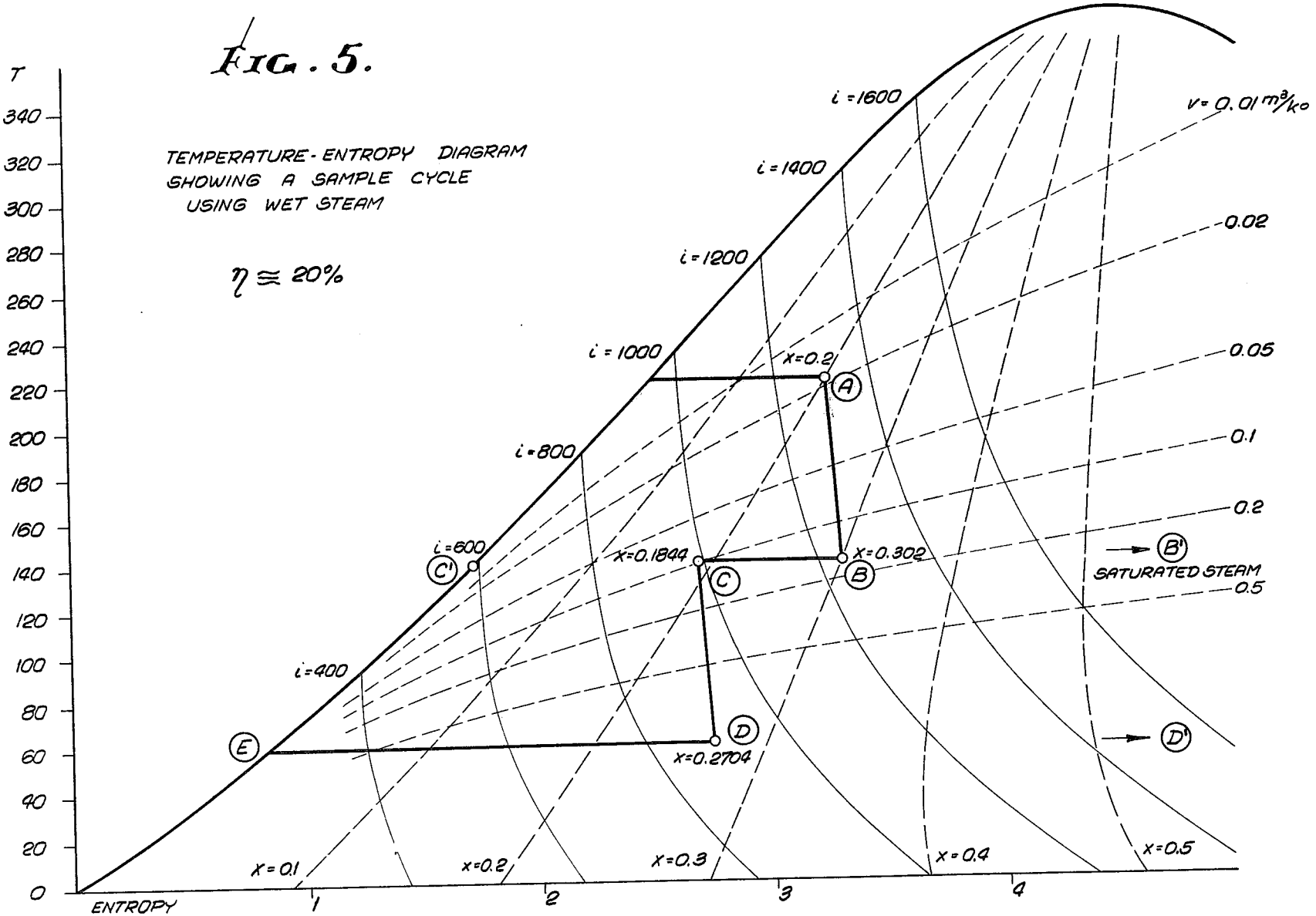
FIG. 5 is a temperature-entropy diagram.

The cylic operation of the engine will now be described by reference to the temperature-entropy diagram of FIG. 5, wherein state points are shown in capital letters. Arabic numerals refer to the components already referred to in FIGS. 1–3.

Wet steam of condition Ⓐ is delivered from the boiler to nozzle box 32 (FIG. 1). The special two-phase nozzles use the expanding vapor for the acceleration of the liquid droplets so that the mixture of wet steam will enter the turbine ring 42 (FIG. 3) at nearly uniform velocity, at the thermodynamic condition Ⓑ. The liquid will then separate from the vapor and issue through the nozzles 47 (FIG. 3) and collect in a rotating ring in the drum 55 (FIG. 1). The scoop 57 will deliver collected liquid to the nozzle box 58 at condition Ⓒ'. The saturated expanded steam from nozzle 32 at a condition Ⓑ' (not shown) in the meantime will drive vanes 68 and enter the recuperator 66.

In the recuperator the vapor will be partially condensed by direct contact with feed-water originally at condition Ⓔ from scoop 90 in FIG. 1, mixed with condensate as it is returned from the condenser CC. Both streams of liquid (at condition Ⓔ) whether supplied by scoop 90 or that returning from the condenser CC is pumped up at 60 to the static pressure of the steam entering zone 66 (FIG. 1). The heat exchange by direct contact occurs across the surfaces of spherical droplets that are spun-off from the rotating discs of the TESLA pump, and into zone 66.

The heated liquid of condition Ⓒ' that is derived from preheating by the steam and augmented by condensate formed at condition Ⓒ, is scooped up at 70 and returned to the boiler BB by stationery lines 71 and 72.

The steam which was not fully condensed in the recuperator 66 will pass on at 74 to nozzle box 58 where it is mixed with the liquid that was returned by scoop 57.

The mixture will be at a condition Ⓒ, corresponding to the total amount of preheated liquid of condition Ⓒ' and saturated vapor of condition Ⓑ'.

The subsequent nozzle expansion at 58 from condition Ⓒ to Ⓓ results in similar velocities as produced in the expansion Ⓐ to Ⓑ in nozzle 32. The issuing jet can therefore drive the second liquid turbine efficiently at the speed of the first turbine, so that direct coupling of the two stages is possible.

The path of the liquid collected in drum 25 (FIG. 1) at the condition E was already described as it is passed on to the inlet 65 of pump 60. The saturated vapor at condition Ⓓ' (not shown) is ducted at 78 and 79 to the condenser CC, which is cooled by a separate coolant. The condensate at condition E is then also returned at 83 to the pump inlet 65.

Alternate ways of condensing the steam of condition Ⓓ' may be envisioned that are similar to the method employed herein to condense steam of condition Ⓑ' at intermediate pressure in the recuperator. The difference is that a direct contact low pressure condenser will require clean water to be used for the coolant, so that mixing with the internal working medium is possible. Such a liquid coolant will probably best be cooled itself in a separate conventional liquid-to-liquid or liquid-to-air heat exchanger, so that it may be re-circulated continuously in a closed, clean system.

The turbine engine described in FIG. 1 is a two-stage unit with only one intermediate recuperator. An analysis of the efficiency of the thermodynamic cycle shows that the performance is improved among others by two factors:

(1) increased vapor quality of the steam (relative mass fraction of saturated steam)

(2) An increased number of intermediary recuperators. Since an increase in vapor quality raises the magnitude of the nozzle discharge velocity, a compromise is called for between number of pressure stages, allowed rotor tip speed, and number of recuperators. Note that saturated steam may be extracted at equal increments along the nozzle; at least two recuperators operating at intermediate pressure levels may be arranged per stage in order to improve the cycle efficiency without increasing the nozzle velocity.

Other types of liquid turbines may be used instead of the particular turbine shown in FIG. 1 and FIG. 2. See for example U.S. Pat. Nos. 3,879,949 and 3,972,195.

Also, a more conventional turbine with buckets around the periphery may be employed and which admits a homogeneous mixture of saturated steam and saturated water droplets.

Good efficiencies for such turbines are obtainable if the droplet size of the mixture emerging from the nozzle is kept at a few microns or less.

Figure 6:
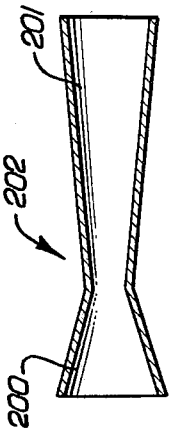
FIG. 6 is a side elevation of a nozzle, taken in section.

To achieve the latter, the converging-diverging nozzle may be designed with a sharp-edged throat as a transition from a straight converging cone 200 to a straight diverging cone 201. See FIG. 6 showing such a nozzle 202.

FIG. 1 also shows annular partition 95 integral with rotor 55, and separating rotary ring of water 56 from rotary ring 91 of water.

I claim:

1. In a turbine, the combination comprising (a) first nozzle means to which wet steam is supplied for expansion in the nozzle means, (b) a turbine rotor having first vanes to receive and pass water supplied via the nozzle means and forming a ring of water proximate said first vanes, the rotor also having second vanes to which steam is supplied via the nozzle means, (c) rotary means to receive feed water and to pressurize same, and (d) a recuperative zone communicating with said rotary means and with said second vanes to receive the pressurized feed water and the steam that has passed said second vanes for fluid mixing in said zone and for enabling direct heat exchange from the steam to the feed water, the fluid mix in said zone being withdrawn for heating and supply to said first nozzle means as wet steam.

2. The combination of claim 1 including second nozzle means to which water passed by said first vanes is supplied for expansion in the second nozzle means producing vapor and water, the rotor having third vanes to receive and pass water separated from vapor in the second nozzle means, the rotor also having fourth vanes between which the vapor is directed.

3. The combination of claim 1 wherein said first nozzle means is stationary, and includes a circular series of nozzle sections spaced about an axis defined by the rotor.

4. The combination of claim 2 including a freely rotating rotor extending about said turbine rotor to receive the water passing said first vanes as a ring of water rotating with said freely rotating rotor for said supply to said second nozzle means.

5. The combination of claim 4 including a scoop to collect water from said rotating ring, the scoop communicating with the second nozzle means.

6. The combination of claim 4 wherein the freely rotating rotor also extends about said second nozzle means to receive the water passing said third vanes for re-supply to said rotary means to centrifugally pressurize feed water.

7. The combination of claim 1 wherein said rotary means to pressurize feed water comprises a centrifugal pump.

8. The combination of claim 1 including a scoop to collect the mix in said recuperative zone and withdraw same for said supply to said first nozzle means.

9. The combination of claim 8 including fixed structure defining ducting communicating with said scoop to supply withdrawn fluid mix to a heater from which the fluid mix is supplied to the first nozzle means as wet steam.

10. The combination of claim 6 including a scoop to collect water received by the freely rotating rotor in a second rotating ring, after passing said third vanes, for said re-supply to said rotary means.

11. The combination of claim 10 wherein the freely rotating ring includes a partition separating said first and second rotating rings of water.

12. The combination of claim 1 including structure supporting said turbine rotor and said rotary means, for independent coaxial rotation.

13. The combination of claim 4 including structure supporting said turbine rotor, said rotary means and said freely rotating rotor, for independent coaxial rotation, and a casing extending about said turbine rotor, said rotary means and said freely rotating rotor.

14. The combination of claim 8 including a boiler to receive the mix collected by the scoop, to heat the mix, and to supply the mix as wet steam to said first nozzle means.

15. The combination of claim 2 including a condenser to receive vapor passed by the fourth vanes, to condense said vapor and to supply condensate to said rotary means (c) of claim 1.

16. The combination of claim 13 wherein said rotary means is located between said first nozzle means and said second nozzle means.

17. The combination of claim 1 wherein said first nozzle means include like segments spaced about an axis defined by said first rotor, said segments defining venturi shaped nozzle passages directed at angles relative to radii from said axis and shaped to separate water droplets from said steam.

18. The combination of claim 17 wherein said first vanes are spaced about said axis to retain said ring of water for rotation with said turbine rotor, there being exit nozzles carried by the turbine rotor to which water subjected to centrifugal pressurization in said ring is delivered, the exit nozzles angled to form exit jets producing thrust acting to rotate the turbine rotor.

19. The combination of claim 1 wherein the nozzle means comprises a nozzle having a sharp throat between a converging section and a diverging section.

* * * * *